United States Patent [19]

Staye

[11] Patent Number: 4,473,262

[45] Date of Patent: Sep. 25, 1984

[54] LATCHING DEVICE FOR LATCHING A DRAWER TO A DRAWER SLIDE

[75] Inventor: Ross Staye, Kitchener, Canada

[73] Assignee: Jacmorr Manufacturing Limited, Kitchener, Canada

[21] Appl. No.: 438,540

[22] Filed: Nov. 1, 1982

[51] Int. Cl.[3] ..... E21B 88/04

[52] U.S. Cl. ..... 312/333; 312/330 R

[58] Field of Search ..... 292/80, 87; 312/333, 312/348, 330 R

[56] References Cited

U.S. PATENT DOCUMENTS

| | | | |
|---|---|---|---|
| 567,693 | 9/1896 | Smith | 312/348 |
| 2,606,091 | 8/1952 | Buchy et al. | 312/346 |
| 3,203,749 | 8/1965 | Bullock et al. | 312/339 |
| 3,677,396 | 7/1972 | Leclair | 312/333 |
| 3,701,577 | 10/1972 | Fischer | 312/339 |
| 3,904,254 | 9/1975 | Hagen et al. | 308/3.8 |
| 4,067,632 | 1/1978 | Sekerich | 312/341 R |

*Primary Examiner*—William E. Lyddane
*Assistant Examiner*—Joseph Falk
*Attorney, Agent, or Firm*—Ridout & Maybee

[57] ABSTRACT

A latching device for latching a drawer to a drawer slide. The upper surface of the drawer slide is formed with a notch. A rail is connected on a side of the drawer and rests on the drawer slide. A catch is connected to the rail, the catch releasably engages the notch in the drawer slide.

19 Claims, 5 Drawing Figures

LATCHING DEVICE FOR LATCHING A DRAWER TO A DRAWER SLIDE

The present invention relates to a latching device for latching a drawer to a drawer slide of the type in which the upper surface of the drawer slide is formed with a notch. A rail is connected on the side of the drawer and rests on and is supported on the upper side of the drawer slide. A catch is connected on the rail and is releasably engageable with the notch in the drawer slide. This arrangement permits the drawer together with the rail and catch to be readily assembled to or disassembled from the drawer slide structure.

With the known arrangements of which the applicant is aware, the catch is pivotally connected on the rail by a pivot pin passing through the catch, the pin being riveted to the rail. The attachment of the pivot pin by riveting is, however, a relatively time consuming and expensive operation. Frequently, it is desired to paint the rail to match the appearance of the drawer, and this is difficult with the known arrangements, as if the paint is applied after the catch is riveted to the rail it is difficult to obtain an even paint coating as the catch tends to mask portions of the rail and, if a plastic catch is used the plastic does not accept the paint well and the result is unsightly, while if the catch is riveted to the rail after painting, the riveting operation tends to damage the paint work.

The present invention provides a latching device for latching a drawer to a drawer slide having a notch in its upper surface, comprising a rail having a horizontal web formed with a slot, and an upstanding flange along one edge, connection points on the flange for connecting the flange to the side of the drawer, and a one-piece resilient plastic catch having a relatively inflexible body snap-coupled to co-operating snap-coupling attachment means on the web, a relatively flexible neck molded integrally with the body, and a relatively inflexible head molded integrally with the neck and normally passing through the slot in the web for engagement with the notch in the slide and being pivotable upwardly by flexure of the neck relative to the body to release the engagement of the head with said notch.

With this arrangement, the plastic catch can be snap-fitted onto the rail easily and the need for a riveting operation is avoided. In the case in which the rail is to be painted, the catch can be snapped onto the rail after the painting operation, without damaging the paint work. The relatively inflexible body and head portions provide for secure engagement of the catch in the notch in the slde and for secure snap-coupling engagement of the body to the web of the rail while the flexible neck provides for ready engagement and disengagement of the head from the notch by flexure of the catch.

In the preferred form, the body of the catch and the web are provided with an interengaging abutment and recess which locate the body against movement laterally of the web and further carry interengaging laterally projecting retaining and engagement members which retain the body against movement upwardy away from the web, and the laterally projecting retaining and engagement members bias the body downwardly toward the web whereby the abutment and recess are biased positively into engagement with one another. This permits secure snap-coupling of the body of the catch to the web and at the same time permits the catch to be readily manipulated to snap-couple it to the rail.

One preferred form of the latching device according to the invention is illustrated in the accompanying drawings in which.

Figure 1:
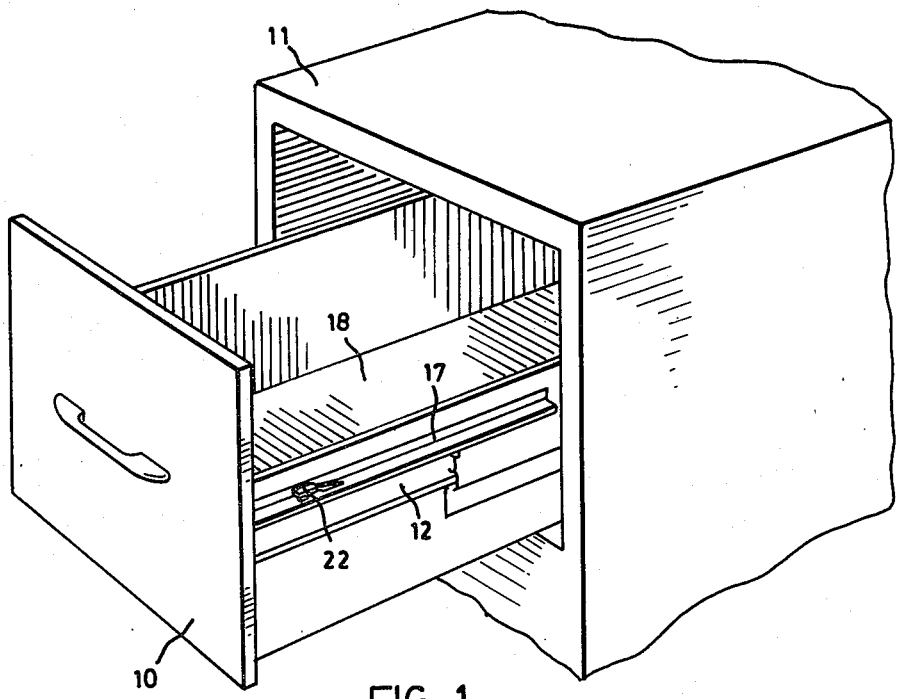
FIG. 1 shows a perspective view of a drawer mounted within a cabinet employing a latching device according to the invention.

Referring to the drawings, in FIG. 1 a drawer 10 is shown mounted within a cabinet 11 on a slide 12. The slide comprises an upper slide member 13 mounted for longitudinal sliding on an inner rail 14 through a linear ball bearing 16.

The drawer 10 is connected to the slide 12 through a support rail 17 connected to a slide 18 of the drawer 10. The rail 17 is provided with connection points, in this example holes 19 through an upwardly extending edge flange 21 of the rail 17. Screws are passed through the holes 19 to connect the rail 17 to the drawer 10. A one piece molded resilient plastic catch 22 is snap-coupled to a horizontal web portion 23 of the rail 17.

Figure 3:
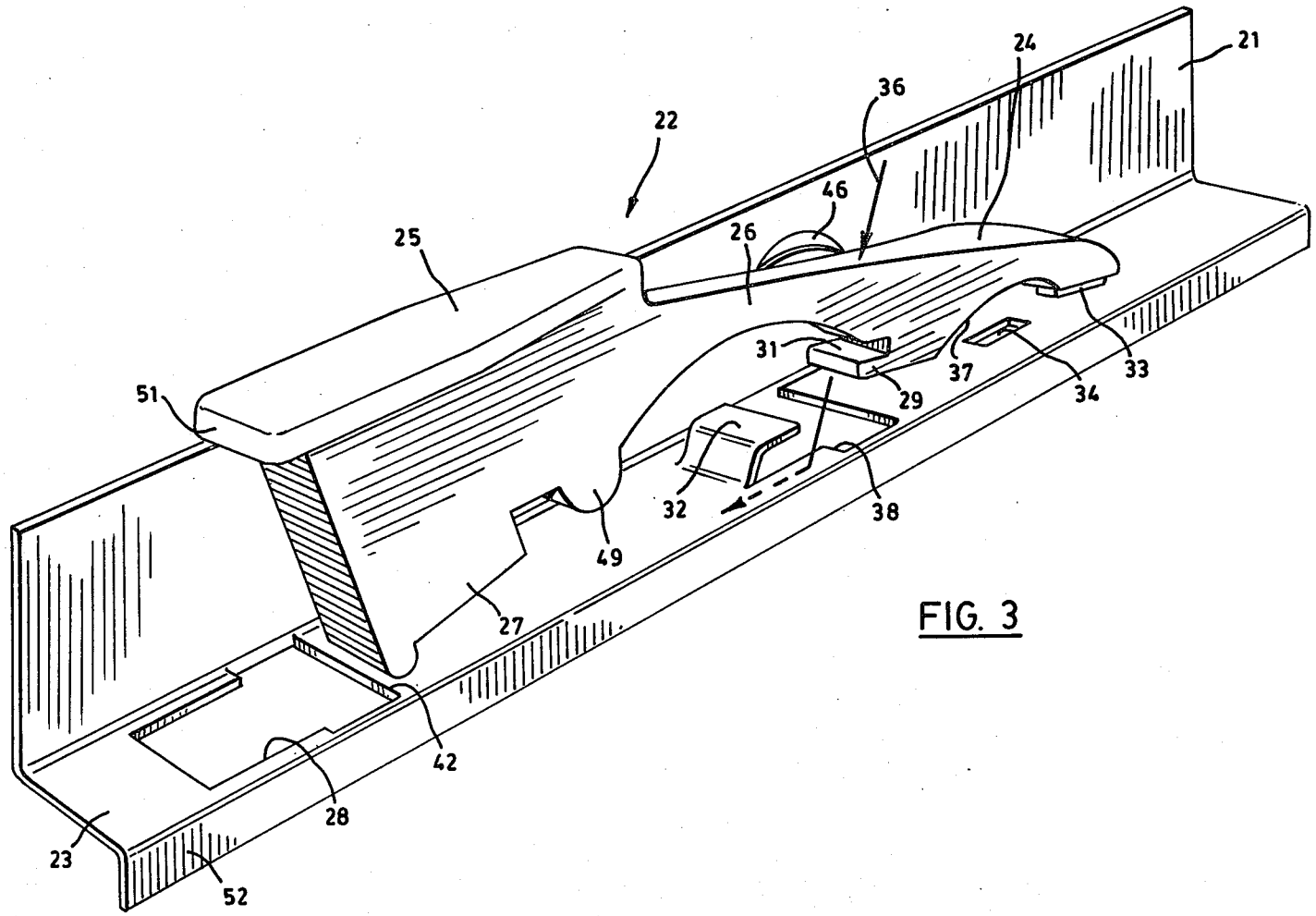
FIG. 3 shows on a larger scale the catch in the course of assembly with the rail.

As shown in more detail in FIG. 3, the catch 22 has a head 25, a body 24 and a neck 26 of relatively thin cross-section compared to the head 25 and body 24, so that the neck portion 26 is relatively flexible permitting the head 25 to be flexed upwardly and downwardly relative to the body 24.

The head 25 has a downwardly projecting lower portion 27 adapted to be passed through a slot 28 in the web 23. The body 24 and the web 23 are formed with co-operating snap-coupling attachment means including an interengaging abutment and recess and laterally projecting retaining and engagement members which, when the catch 22 is snap-coupled to the web 23 retain the body 24 against upward movement away from the web 23 and serve to positively snap the abutment into the recess to locate the catch laterally relative to the web 23.

In this example, the underside of the body 24 is formed with a laterally projecting retaining member in the form of an integrally molded hook 29 defining a recess 31 facing toward the head 25 and the web 23 is formed with a laterally projecting engagement member in the form of a tab 32 bent upwardly from the web with its free end facing away from the slot 28. The end of the body remote from the head 25 is formed with a projecting abutment in the form of an integrally-molded downwardly-directed rectangular stub 33 which is adapted to be snugly received in a recess in the web 23, in this example in the form of a rectangular hole 34 in the web 23.

Figure 4:
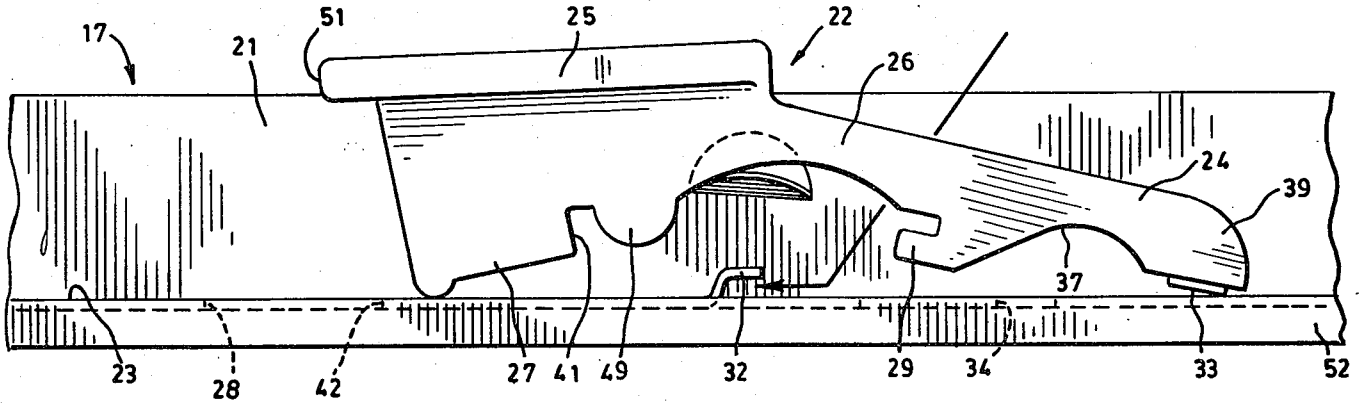
FIG. 4 shows a side view corresponding to FIG. 3.
Figure 5:
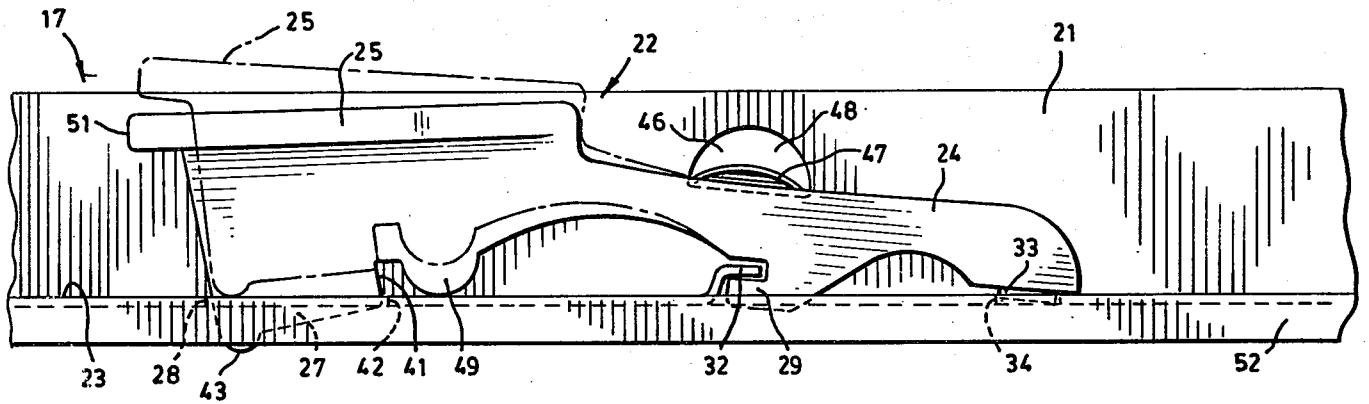
FIG. 5 shows the catch snap fitted to the rail in side view, with the head of the catch in raised position shown in broken outline.

To assemble the catch 22 to the rail 17, some pressure is applied on the upper side of the body at the point indicated by the arrow 36 in FIGS. 3 and 4 so that the catch 22 is slid laterally forwardly along the web 23 and the portion of the body 24 carrying the hook 29 is flexed downwardly relative to the portion carrying the stub 33, which at this time bears on the upper side of the web 23 rearwardly of the slot 34. To assist in flexing the body portion, its underside is formed with a concave indentation 37. As the catch 22 slides forwardly, the hook 29 engages tabs 32, and enters an opening 38 formed adjacent the tab 32, while simultaneously the stub 33 which is biased downwardly by the resilient flexure of the body portion 24 snaps positively into the hole 33, and lower portion 27 of the head 25 enters the slot 28, as shown in FIG. 5. In the preferred form as shown, the upper side of the body 24 is smoothly convexly curved at the end 39 remote from the head 25, to avoid any sharp corners which could injure the thumb of the assembler.

It will be noted that with this arrangement, in the assembled condition as shown in FIG. 5, the tab 32 biases the portion of the body 24 adjacent the hook 29 resiliently downwardly relative to the portion of the body 24 adjacent the stub portion 33, so that the underside of the body portion 24 adjacent the stub 33 is pressed positively resiliently downwardly into engagement with the upper surface of the web 23 bordering the hole 34, and so that the stub 33 is locked positively into the hole 34. Thus, the engagement of the stub 33 in the hole 34 resists lateral displacement of the catch 22 relative to the rail 17, while the engagement of the hook 29 with the tab 32 retains the body 24 against upward displacement away from the web 23.

In the preferred form, in the assembled condition as shown in FIG. 5, the side of the lower portion 27 of the head 25 facing toward the body 24 engages or is closely adjacent to the adjacent side 42 of the slot 28 and in the assembled condition the side 41 inclines downwardly toward the body 24, so that the engagement of the side 41 of the head with the side 42 of the slot 28 also resists lateral displacement of the catch 22 tending to disengage the hook 29 from the tab 32.

Figure 2:
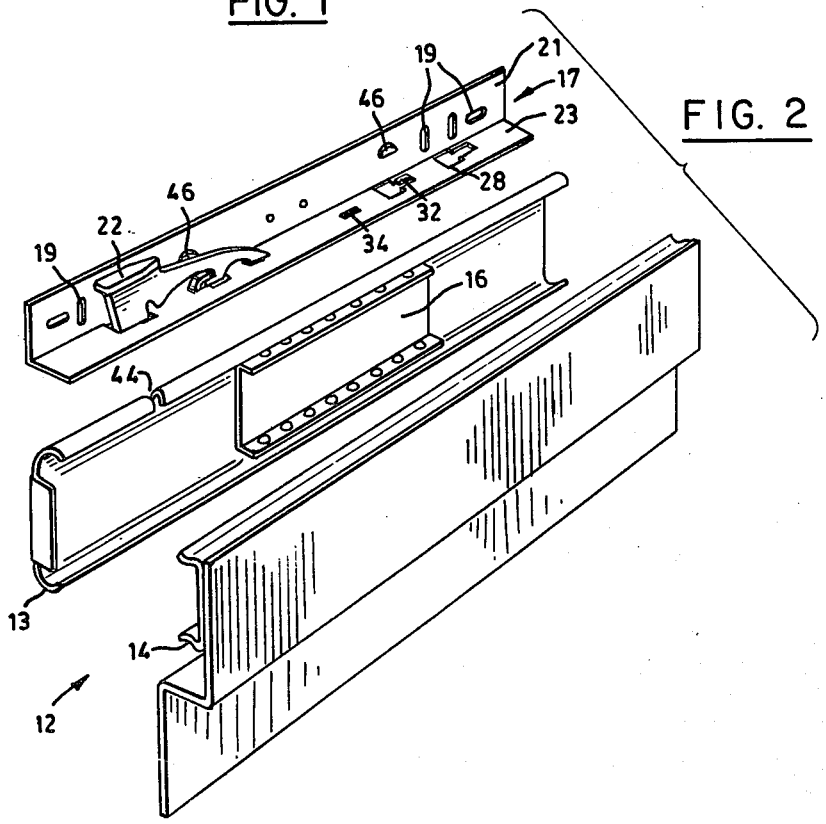
FIG. 2 shows an exploded view on a larger scale of the arrangement of the latching device and the drawer slide.

The lower portion of the head 27 carries a downwardly projecting nose portion 43. In the assembled condition in which the drawer equipped with the rail 17 and the catch 22 are mounted on the slide 12, the nose portion 43 enters a slot 44 in the upper surface of the upper slide 13, as shown in FIG. 2. The engagement of the nose 43 in the slot 44 retains the rail 17 against longitudinal displacement relative to the slide 13 so that in the assembled condition the drawer 10 moves together with the slide 13. To disengage the drawer 10 from the slide 13, the head 25 of the catch 22 is raised upwardly to the position shown in broken outline in FIG. 5, in which position the nose 43 is freed from its engagement with the slot 44, and the drawer together with the rail 17 and the catch 22 can be removed longitudinally from the slide 13. To assemble the drawer with the slide 13, the reverse procedure is followed, the catch 22 being lifted slightly upwardly by finger pressure if necessary to hold the head 25 in its upper position shown in broken outline in FIG. 5 and the finger pressure being released to permit the head 25 to pivot resiliently downwardly to its lower position in which the nose 43 enters the slot 44.

In the preferred form, the edge flange 21 of the rail 17 is formed with a projection 46, for example, engaging the upper side of the body 24 adjacent the neck 26 to retain the body 24 in its snapped in position and to avoid the upward flexure of the head 25 about the neck 26 from disturbing the engagement of the hook 29 with the tab 32 and the engagement of the stub 33 in the hole 34. Further the projection prevents the upward flexure of the head 25 above the memory position of the body 24 to avoid imparting a permanent strain to the neck 26 which would result in the lower portion 27 of the head 25 fitting more loosely within the slot 28.

In the example shown, this projection is in the form of an approximately semi-circular portion of the wall of the flange 21 which is struck inwardly to form a tab 46 having an inwardly projecting free lower edge 47 which engages the upper side of the body 24. The upper side of the tab 46 is approximately part spherical and provides a smoothly downwardly and outwardly sloping upper surface 48 over which the underside of the neck 26 rides when the catch 22 is pressed downwardly as described above with reference to FIGS. 3 and 4 to snap-couple the body 24 to the web 23.

The lower side of the head 25 between the lower portion 27 and the neck 26 is formed with a convex downward projection 49 which in the asembled condition as shown in FIG. 5 engages the upper surface of the web 23. This limits the extent of projection of the lower portion 27 and the nose 43 of the head 25 downwardly through the opening 28 to avoid these interfering with the operation of the slide mechanism 12. The catch is configured so that in the assembled condition as shown in FIG. 5 the resiliency of the catch biases the head portion 25 downwardly with the projection 49 positively biased downwardly into contact with the upper side of the web 23 i.e. the head portion 25 is biased somewhat upwardly relative to the neck 26 as compared with its relaxed condition, so that there is a definite downward force tending to resist upward pivoting of the head 25 to the position shown in broken outline in FIG. 5. In order to assist in lifting the head 25 to its upwardly pivoted position, the upper side of the head 25 is formed wih a laterally projecting edge portion 51 which projects from the end of the head 25 remote from the body 24, to provide a finger grip to permit the user to raise the head 25 to its upwardly pivoted position.

The rail 17 may be formed with a short downwardly depending flange 52 on the edge opposite the upstanding flange 21 to assist in locating the rail 17 on the upper side of the slide member 13.

In the preferred form, the rail 17 is symmetrical about a transverse median line, and is provided with a set of holes 34, tabs 32 and 46 and the slot 28 at each end, so that the rail 17 can be used on either side of the drawer 10.

The catch 22 may be molded from any stiffly resilient plastic material having sufficient toughness to withstand repeated flexure and a sufficiently stiff resiliency to permit the catch to snap-couple with the cooperating members formed on the rail 17 as described above. For example, the catch 22 may be molded of nylon or of PVC.

I claim:

1. A latching device for latching a drawer to a drawer slide having a notch in its upper surface, comprising a rail having a horizontal web formed with a slot, and an upstanding flange along one edge, connection points on the flange for connecting the flange to the side of the drawer, and a one-piece resilient plastic catch having a relatively inflexible body snap-coupled to co-operating snap-coupling attachment means on the web, a relatively flexible neck molded integrally with the body, and a relatively inflexible head molded integrally with the neck and normally passing through the slot in the web for engagement with the notch in the slide and being pivotable upwardly by flexure of the neck relative to the body to release the engagement of the head with said notch.

2. A device as claimed in claim 1 in which the neck has a relatively thin cross-section as compared with the head and the body.

3. A device as claimed in claim 1 in which one of the body and web carries a projecting abutment and the other has a recess co-operating with the abutment to retain the body against movement laterally of the web, and one of the body and the web carries a laterally projecting retaining member and the other has a laterally projecting engagement member co-operating with the retaining member to retain the body against movement upwardly away from the web.

4. A device as claimed in claim 3 in which the retaining member and engagement member bias the adjacent portion of the body resiliently downwards toward the web whereby the abutment and recess are biased into engagement with one another.

5. A device as claimed in claim 1 in which the body has an integrally molded stub and an integrally molded hook on its lower side, the hook defining a recess facing toward the head, and the coupling attachment means on the web comprise a hole snugly receiving the stub and a tab bent upwardly from the web with a free end facing away from the slot and received in said recess, the tab biasing the portion of the body carrying the hook resiliently downward toward the web relative to the portion carrying the stub.

6. A device as claimed in claim 5 in which the stub is formed adjacent the end of the body remote from the head and the hook is spaced between the stub and the neck.

7. A device as claimed in claim 6 in which the underside of the body is formed with an indentation between the hook and the tab.

8. A device as claimed in claim 1 having a projection with a downwardly and outwardly sloping upper surface on the flange of the rail engaging the upper side of the body adjacent the neck.

9. A device as claimed in claim 1 having a tab bent inwardly from the side of the flange of the rail, the lower surface of the tab engaging the upper side of the body adjacent the neck, and the upper surface of the tab sloping downwardly and outwardly.

10. A device as claimed in claim 9 in which said tab overlies the part of the body having the hook formed on its underside.

11. A device as claimed in claim 9 in which the tab is formed by an approximately semi-circular portion of the wall of the flange.

12. A device as claimed in claim 1 in which the upper side of the body is smoothly convexly curved at the end remote from the head.

13. A device as claimed in claim 1 in which a side of the head facing toward the body engages or is closely adjacent to the adjacent side of the slot.

14. A device as claimed in claim 13 in which in the normal position said side inclines downwardly toward the body.

15. A device as claimed in claim 1 in which the head portion includes a downward projection engaging the upper side of the web adjacent the slot.

16. A device as claimed in claim 15 in which the projection is formed between a portion of the head passing through the slot and the body.

17. A device as claimed in claim 1 in which the upper side of the head is formed with a laterally projecting edge portion.

18. A device as claimed in claim 17 in which the edge portion projects from the end of the head remote from the body.

19. A device as claimed in claim 5 wherein the rail is symmetrical about a transverse median line and the web portion of the rail is formed adjacent each of its ends with said tab and said hole and slot.

* * * * *